US005148816A

United States Patent [19]

Heitmann

[11] Patent Number: 5,148,816

[45] Date of Patent: Sep. 22, 1992

[54] METHOD OF AND APPARATUS FOR MAKING A TOBACCO STREAM WITH A CORE CONTAINING TOBACCO RIBS

[75] Inventor: Uwe Heitmann, Hamburg, Fed. Rep. of Germany

[73] Assignee: Körber AG, Hamburg, Fed. Rep. of Germany

[21] Appl. No.: 613,201

[22] Filed: Nov. 8, 1990

[30] Foreign Application Priority Data

Nov. 25, 1989 [DE] Fed. Rep. of Germany ..... 3939036

[51] Int. Cl.[5] ..... A24C 5/00

[52] U.S. Cl. ..... 131/84.1; 131/109.2; 131/110

[58] Field of Search ..... 131/84.1-84.3, 131/109.2, 109.3, 110

[56] References Cited

U.S. PATENT DOCUMENTS 4,003,385 1/1977 Adebahr et al. ..... 131/109.2 X
4,185,644 1/1980 Heitmann ..... 131/109
4,616,663 10/1986 Lorenzen et al. ..... 131/109.3
4,627,447 12/1986 Brackmann et al. ..... 131/109.2 X
4,646,759 3/1987 Thatcher et al. ..... 131/109.2 X
4,729,388 3/1988 Mattei ..... 131/109.2
4,889,138 12/1989 Heitmann ..... 131/84.1

FOREIGN PATENT DOCUMENTS 1719730 11/1986 Fed. Rep. of Germany .

*Primary Examiner*—V. Millin
*Assistant Examiner*—J. Doyle
*Attorney, Agent, or Firm*—Peter K. Kontler

[57] ABSTRACT

Smaller and larger fragments of tobacco ribs are sifted out of a mixture of tobacco ribs and tobacco shreds before the shreds are converted into a rod-like filler which is ready to be draped into a web of cigarette paper. The larger ribs are comminuted and are mixed with smaller ribs prior to readmission into the flow of shreds in such a way that the readmitted ribs are located in the inner portion of the rod-like filler so that they are less likely to puncture the wrapper and that they contribute to hardness of the filler.

23 Claims, 3 Drawing Sheets

Fig. 4
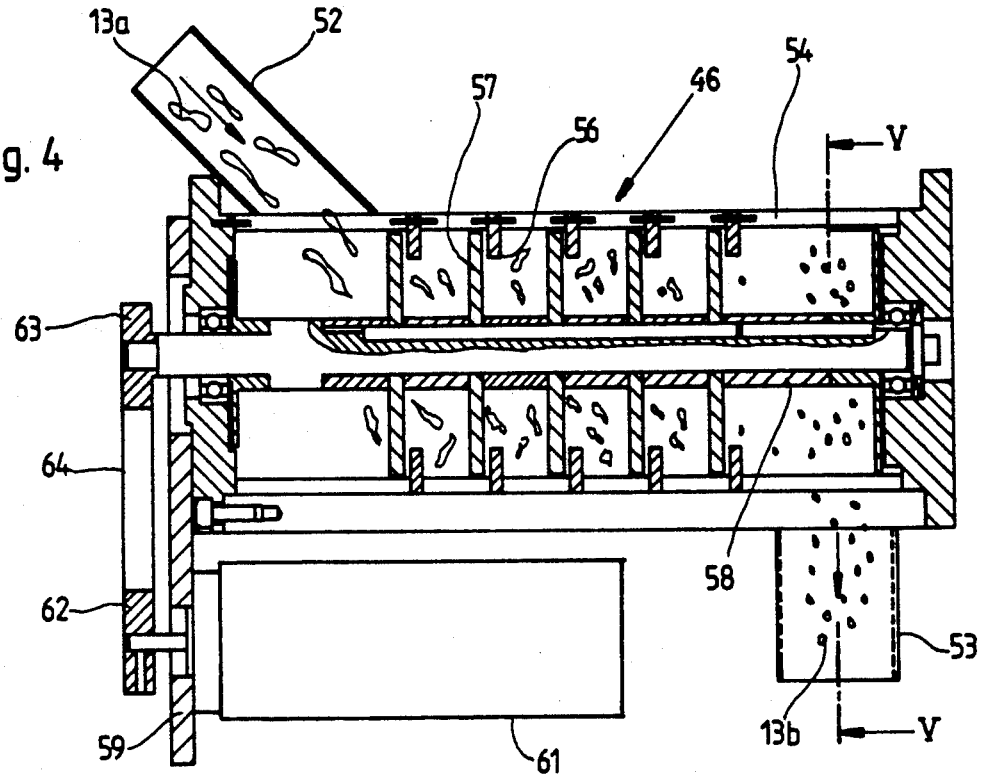
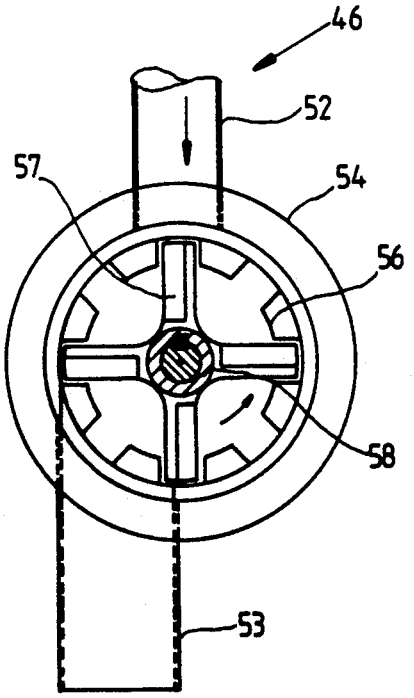
Fig. 5
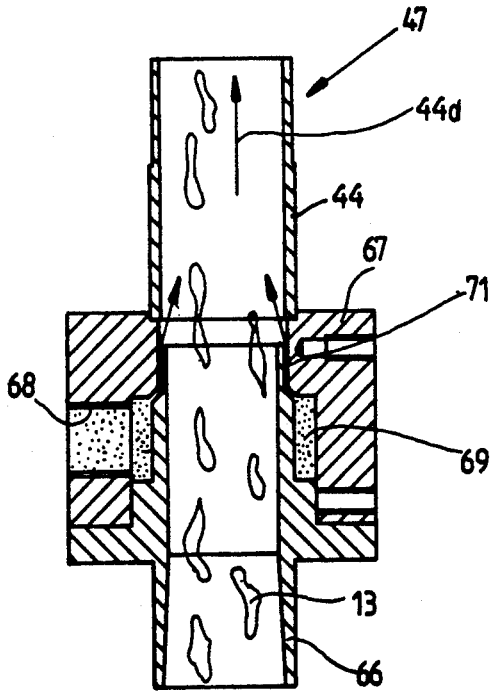
Fig. 6

METHOD OF AND APPARATUS FOR MAKING A TOBACCO STREAM WITH A CORE CONTAINING TOBACCO RIBS

BACKGROUND OF THE INVENTION

The invention relates to a method of and to an apparatus for making a stream of fibrous material, especially tobacco. More particularly, the invention relates to improvements in methods of and in apparatus for making a stream which contains tobacco shreds as well as tobacco ribs and which can be converted into the filler of a tobacco-containing rod, e.g., a cigarette rod which is ready to be subdivided into plain cigarettes of unit length or multiple unit length.

It is known to gather tobacco shreds into an elongated flow of loose tobacco particles and to convey the flow along an elongated first path. Successive increments of the flow are transferred into a second path wherein the transferred increments constitute successive increments of a relatively dense elongated stream which is ready to be trimmed or equalized and draped into a web of cigarette paper or other suitable wrapping material. The transfer of successive increments of the flow of loose tobacco particles into the second path takes place in a so-called stream building zone wherein the second path normally extends transversely of the first path. The thus obtained stream is advanced axially or lengthwise toward and through a trimming station and thereupon through a wrapping station before it reaches a so-called cutoff which subdivides the wrapped tobacco filler (i.e., the trimmed or equalized and wrapped stream) into a series of discrete rod-shaped articles, e.g., into plain cigarettes of unit length or multiple unit length.

Tobacco shreds are loosened in a so-called distributor (also called hopper) which defines the first path and is equipped with means, such as nozzles which discharge jets of compressed air and/or one or more suction conveyors, for advancing the flow along the first path toward and into the stream building zone. The second path is normally defined by an endless foraminous belt conveyor which is adjacent a suction chamber and has an elongated stretch confined in a tobacco channel and defining with the latter the aforementioned stream building zone. The channel is located upstream of a trimming or equalizing device which removes the surplus so that the stream is converted into a rod-like filler which is ready to be draped into a web of cigarette paper or other suitable wrapping material.

The flow of loose tobacco particles contains tobacco shreds as well as at least some tobacco ribs. The ribs are relatively stiff and are likely to affect the quality of the wrapped filler, especially if they are permitted or caused to accumulate in the outer portion of the filler. Such ribs can puncture the very thin wrapping material to thus permit uncontrolled penetration of atmospheric air into a rod-shaped product containing the respective portion of the wrapping material. Moreover, non-uniform or unpredictable distribution of tobacco ribs in the filler of a tobacco rod affects the quality of the product. For example, relatively large tobacco ribs are likely to be combusted at a rate which is slower than the rate of combustion of smaller ribs and/or shreds so that glowing large ribs can project beyond the lighted end of a partially consumed cigarette and can fall onto the ground with the resulting danger of fire or damage to the floor or floor covering. Therefore, it is desirable to ensure a highly predictable distribution of tobacco ribs among the shreds as well as to prevent penetration of relatively large ribs into that portion of the path for acceptable comminuted tobacco particles (shreds) in which the filler is formed and draped into cigarette paper or the like.

OBJECTS OF THE INVENTION

An object of the invention is to provide a novel and improved method which renders it possible to turn out high-quality rod-shaped smokers' products with a greater degree of predictability than in accordance with heretofore known methods.

Another object of the invention is to provide a novel and improved method of distributing tobacco ribs in accumulations of other comminuted portions of tobacco leaves.

A further object of the invention is to provide a method which renders it possible to concentrate the tobacco ribs in a selected portion of a rod-like tobacco filler.

An additional object of the invention is to provide a novel and improved method of processing tobacco ribs in a tobacco rod making machine.

Still another object of the invention is to provide a method which renders it possible to utilize all tobacco ribs, including those which are relatively large or too large at the time they issue from a tobacco shredding machine, in a tobacco filler without affecting the quality of rod-shaped smokers' products which contain portions of the filler.

A further object of the invention is to provide a novel and improved method of manipulating comminuted tobacco ribs in and downstream of a distributor or hopper in a cigarette rod making machine or an analogous machine.

Another object of the invention is to provide a novel and improved method of classifying certain fragments of tobacco leaves.

An additional object of the invention is to provide a method which renders it possible to turn out one or more elongated tobacco fillers of uniform quality even though the filler or fillers contain different types of comminuted tobacco leaves including tobacco shreds and cut tobacco ribs.

A further object of the invention is to provide a novel and improved apparatus for the practice of the above outlined method.

Another object of the invention is to provide an apparatus which can be built into existing cigarette rod making and other tobacco rod making machines.

Still another object of the invention is to provide the apparatus with novel and improved means for processing tobacco ribs.

A further object of the invention is to provide the apparatus with novel and improved means for mixing tobacco shreds and tobacco ribs in a highly predictable manner.

An additional object of the invention is to provide the apparatus with novel and improved means for classifying tobacco ribs.

Another object of the invention is to provide the apparatus with novel and improved means for segregating tobacco ribs from, and for readmitting tobacco ribs into, a flow of loose tobacco shreds.

SUMMARY OF THE INVENTION

One feature of the present invention resides in the provision of a method of making rod-shaped products from tobacco shreds having a first range of sizes and tobacco ribs at least some of which have a second range of sizes larger than the sizes of the first range. The method comprises the steps of accumulating the shreds into an elongated flow of loose shreds, converting successive increments of the flow into successive increments of an elongated stream having an outer portion and an inner portion surrounded by the outer portion, comminuting the at least some tobacco ribs to a range of sizes approximating the first range of sizes, and effecting the introduction of at least the majority of ribs—including the comminuted ribs—into the inner portion of the stream.

The method further comprises the steps of advancing the flow along a first elongated path and transporting the stream along a second elongated path which crosses and extends transversely of the first path. The converting step includes transferring successive increments of the flow from the first path into the second path. Such transferring step is carried out at the locus of crossing of the first and second paths.

The inner portion of the steam has a center, and the introduction effecting step preferably includes effecting introduction of ribs at or at least close to the center of the stream.

The method can further comprise the steps of jointly conveying the shreds and the ribs along a predetermined path prior to the converting step and segregating the ribs from the predetermined path prior to the comminuting step. The segregating step can include sifting the shreds and the ribs in a portion of the predetermined path. Such method can further comprise the step of classifying the segregated ribs according to size prior to the comminuting step. The classifying step can include sieving the ribs, and the comminuting step can include reducing only the size of classified ribs having a size within the second range. The method then further comprises the step of admixing comminuted ribs to the non-comminuted ribs prior to the introduction effecting step. The introduction effecting step can include admitting the comminuted and non-comminuted ribs into the flow of tobacco shreds.

In accordance with a presently preferred embodiment, the introduction effecting step includes pneumatically admitting the ribs into the flow of tobacco shreds, and such step can include admitting the ribs into the flow subsequent to conveying of the ribs along an arcuate path. This can be achieved by moving the ribs along an elongated concave surface.

Another feature of the invention resides in the provision of an apparatus for making rod-shaped smokers' products from tobacco shreds having a first range of sizes and from tobacco ribs at least some of which have a second range of sizes larger than the sizes of the first range. The apparatus comprises means for advancing an elongated flow of loose shreds along a first elongated path, transporting means including a conveyor defining an elongated second path and being arranged to receive successive increments of the flow so that the thus received increment form an elongated stream which advances along the second path in a predetermined direction and has an outer portion and an inner portion surrounded by the outer portion, and means for processing the ribs including means for admitting processed ribs into one of the first and second paths. The transporting means further includes means for establishing with the conveyor an elongated stream building zone having an upstream end and a downstream end (as seen in the predetermined direction). The admitting means can include means for admitting ribs into the first path at a location such that the admitted ribs reach the stream building zone intermediate the upstream and downstream ends of such zone.

The advancing means can include means for advancing a mixture of ribs and shreds toward the second path, and the processing means can include means for segregating ribs from the first path and means for delivering segregated ribs to the admitting means for reintroduction into the first path between the segregating means and the stream building zone. Such processing means can further comprise means for classifying segregated ribs according to size ahead of the delivering means, and the classifying means can include a sifting or sieving device. In accordance with a presently preferred embodiment, the classifying means comprises a vibrating trough and a sieve in the trough. The sieve and the trough define a first compartment which is disposed above the sieve and receives segregated ribs, and a second compartment which is located beneath the sieve. The mesh of the sieve is preferably such that ribs having one of the second range of sizes are intercepted to be advanced in the first compartment whereas the ribs of a size less than one of the second range of sizes are free to enter into and to advance in the second compartment. The processing means which includes the aforediscussed trough can further comprise means for comminuting intercepted ribs which leave by way of the outlet of the first compartment. The comminuting means is located ahead of the delivering means, and the latter preferably includes means for conveying ribs from the outlet of the second compartment as well as the comminuted ribs to the admitting means. The conveying means of the delivering means can include a conduit and a pneumatic ejector in the conduit.

The admitting means can include a concave surface along which the ribs advance toward and into the first path, and such admitting means preferably includes means (for example, the aforementioned concave surface) for introducing ribs into the one path at a location such that the ribs are centered or concentrated in the inner portion of the stream.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 4 is an enlarged central longitudinal sectional view of a comminuting device which can be utilized in the apparatus of FIGS. 1 and 2;

FIG. 5 is a sectional view as seen in the direction of arrows from the line V—V in FIG. 4; and FIG. 6 is a central longitudinal sectional view of a pneumatic ejector which can be utilized in the apparatus of FIGS. 1 and 2.

DESCRIPTION OF PREFERRED EMBODIMENTS

Figure 1:
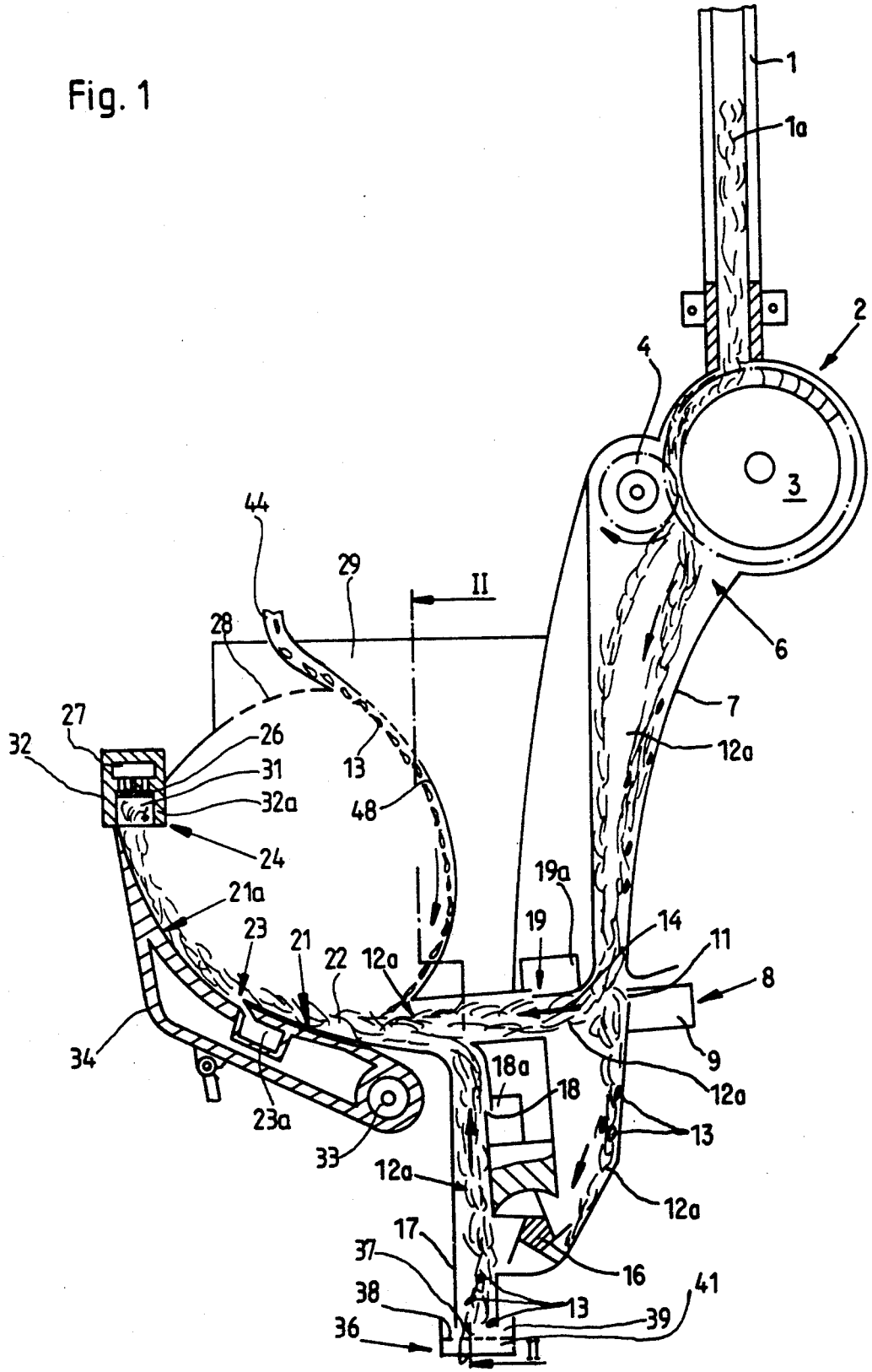
FIG. 1 is a schematic partly elevational and partly longitudinal vertical sectional view of an apparatus which embodies one form of the invention and is designed to produce a single rod-like tobacco filler.

FIG. 1 shows a portion of a cigarette rod making machine which embodies one form of the improved apparatus. The apparatus is part of a distributor (also called hopper) which can be of the type disclosed in commonly owned U.S. Pat. No. 4,185,644 granted Jan. 29, 1980 to Heitmann et al. or in commonly owned German Pat. No. 27 29 730. FIG. 1 merely shows those portions of the distributor which are necessary for a complete understanding of the invention. An upright duct 1 contains a column 1*a* of tobacco particles, namely a mixture of tobacco shreds 12*a* and tobacco ribs 13 which are received from an elevator conveyor of the type shown at 6 in FIG. 1 of U.S. Pat. No. 4,185,644. The column 1*a* of a mixture of shreds 12*a* and ribs 13 rests on the carding at the periphery of a driven wheel 3 forming part of a tobacco removing unit 2 which further includes a rapidly driven picker roller 4. The latter expels particles of tobacco from the carding of the wheel 3 and propels a shower 6 of such particles into the upper end of a funnel-shaped member 7 which can be said to constitute a means for jointly conveying ribs 13 and shreds 12*a* along a predetermined path extending downwardly from the picker roller 4 and wheel 3.

The narrower lower end of the funnel-shaped member 7 delivers the mixture of tobacco shreds and ribs into the range of a device 8 which serves to segregate the ribs 13 from the shreds 12*a*. To this end, the segregating device 8 comprises a plenum chamber 9 which serves as a source of compressed air or another suitable gaseous fluid and carries one or more nozzles 11 serving to discharge one or more jets of compressed gas (hereinafter called air) in the direction of arrow 14, namely transversely of the direction of descent of the mixture in the member 7. The force which is applied by the jet or jets of compressed air issuing from the orifice or orifices of one or more nozzles 11 is selected in such a way that the jets entrain all or nearly all lightweight shreds 12*a* but permit the heavier ribs 13 to descend toward and into the range of a driven cell wheel 16 at the lower end of the member 7. The ribs 13 are likely to entrain some tobacco shreds 12*a*, and such shreds are segregated from the descending ribs 13 in an upright duct 17 which is located downstream of the cell wheel 16 and receives one or more upwardly directed jets of compressed air from one or more nozzles 18 which receive compressed air from a plenum chamber 18*a*. The upwardly directed jet or jets of compressed air create suction which suffices to lift the shreds 12*a* but not the ribs 13.

Recovered tobacco shreds 12*a* which rise in the duct 17 are admitted into the mass of shreds 12*a* advancing in the direction of arrow 14, and such mass is accelerated by one or more jets of compressed air issuing from one or more nozzles 19 which receive compressed air from a plenum chamber 19*a*. This entails further loosening of shreds 12*a* which are accumulated into a loose flow 22 at the concave upper side of a combined shred advancing and accumulating conveyor 21. The loose flow 22 of shreds 12*a* advances along an elongated path toward and into a channel 31 wherein the elongated path is crossed by a substantially horizontal second path which is defined by the lower reach of an endless foraminous belt conveyor 26 in conjunction with the sidewalls or cheeks 32, 32*a* of the channel 31. The flow 22 which advances along the path leading into the channel 31 closely follows the concave upper side of the conveyor 21 and is relatively wide so that, if necessary, it can be divided into a plurality of flows each of which is directed into a discrete channel. Reference may be had, for example, to commonly owned U.S. Pat. No. 4,889,138 granted Dec. 26, 1989 to Heitmann et al. If desired or necessary, the improved apparatus comprises one or more additional plenum chambers 23*a* (one shown in FIG. 1) with one or more nozzles 23 each of which discharges one or more jets of compressed air in a direction to promote advancement of the flow 22 along the conveyor 21 toward and into the channel 31.

The sidewalls 32, 32*a* of the channel 31 cooperate with the lower reach of the conveyor 26 to define an elongated stream building zone 24 (FIG. 2) which has an upstream end 24*a* and a downstream end 24*b* (as seen in the direction of arrow A which denotes the direction of advancement of a stream 49 of tobacco shreds 12*a* and tobacco ribs toward a trimming or equalizing device 53. The lower reach of the conveyor 26 is adjacent the underside of a suction chamber 27 (FIG. 1) which attracts successive increments of the flow 22 to the underside of the lower reach of the conveyor 26 at the locus which is determined by the stream building zone 24. This results in conversion of successive increments of the flow 22 into successive increments of the stream 49. The surplus of compressed air is free to escape through a filter 28 at the intake end of an expansion chamber 29.

The sidewalls or cheeks 32, 32*a* of the channel 31 flank and extend downwardly beyond the lower reach of the conveyor 26. The discharge end 21*a* of the conveyor 21 directs successive increments of the flow 22 against the inner side of the sidewall 32 to ensure predictable admission of successive increments of the flow 22 into the stream building zone 24, preferably all the way between the upstream and downstream ends 24*a*, 24*b* of this zone. The path for advancement of tobacco particles from the discharge end 21*a* of the conveyor 21 into the stream building zone 24 is smooth and is free of gaps. The discharge end 21*a* is preferably formed by a member 34 which is pivotable at 33 to afford convenient access to the channel 31 in the event of malfunction of the apparatus, e.g., due to clogging of the channel 31.

Figures 2, 3:
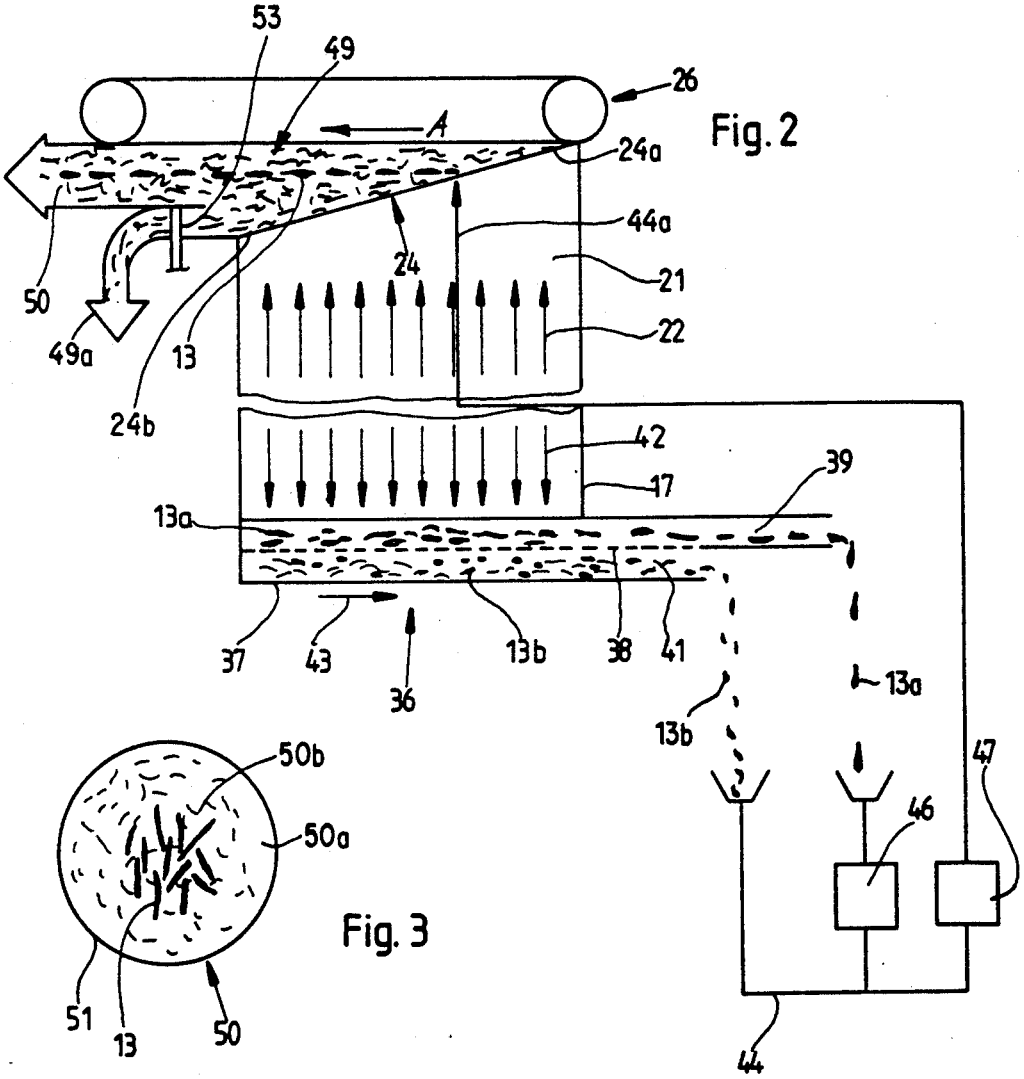
FIG. 2 is a fragmentary schematic transverse vertical sectional view substantially as seen in the direction of arrows from the line II—II of FIG. 1.
FIG. 3 is an enlarged transverse sectional view of a wrapped rod-like tobacco filler which is obtained in the apparatus of FIGS. 1 and 2.

In accordance with a feature of the invention, the duct 17 for retrieval of shreds 12*a* from tobacco ribs 13 is located directly above a sorting unit 36 which serves to classify the ribs 13 according to size. The classifying or sorting unit 36 forms part of a rib processing device which further includes the aforementioned segregating device 8. The unit 36 comprises an elongated vibratory trough 37 which is agitated by an eccentric or in any other conventional way to advance the ribs 13 (which descend in the direction of arrow 42) in a direction to the right as seen in FIG. 2 and as indicated by arrow 43. The trough 37 contains a substantially horizontal sieve 38 which divides the internal space of the trough into an upper compartment 39 and a lower compartment 41. The mesh of the sieve 38 is selected in such a way that relatively large ribs 13*a* are intercepted but the smaller ribs 13*b* are free to pass into the lower compartment 41.

The larger and heavier ribs 13*a* (e.g., those having a size exceeding the size of shreds 12*a*) are advanced toward the outlet of the compartment 39 and descend into a comminuting device 46 of any known design. The device 46 serves to reduce the size of the ribs 13*a* so that the dimensions of comminuted ribs need not or do not exceed those of the non-comminuted ribs 13*b* in the lower compartment 41 of the vibratory through 37.

The shorter or smaller ribs 13*b* descend directly into the inlet of a pneumatic conduit 44 constituting a means for delivering the ribs 13*a*, 13*b* toward and for effecting introduction of such ribs into the stream building zone 24 in such a way that the ribs are admitted midway or nearly midway between the upstream and downstream ends 24*a* and 24*b*. This ensures that the reintroduced ribs are concentrated mainly or exclusively in the inner portion 50*b* (see FIG. 3) of the cylindrical filler or rod 50 which is obtained by trimming the stream 49 downstream of the stream building zone 24. The comminuting device 46 can constitute or include a mill for the larger tobacco ribs 13*a*. Its outlet admits the comminuted ribs 13*a* into the conduit 44, and the latter contains a pneumatic ejector 47 which accelerates and propels a mixture of non-comminuted ribs 13*b* and comminuted ribs 13*a* toward and into the stream building zone 24. The comminuting action at 46 is preferably such that the size of the comminuted ribs 13*a* matches or approximates that of the non-comminuted ribs 13*b*.

As can be seen in FIG. 1, the conduit 44 discharges the mixture of comminuted tobacco ribs 13*a* and non-comminuted tobacco ribs 13*b* against the concave surface of elongated conveying means 48 adjacent the expansion chamber 29. The locus of admission of ribs 13*a*, 13*b* into the flow 22 is selected in such a way that the ribs gather in the aforementioned inner portion or core 50*b* of the filler 50, i.e., at the center of the converted stream 49. This is indicated in FIG. 2 by the arrow 44*a* between the upstream and downstream ends 24*a*, 24*b* of the stream building zone 24. The ribs in the filler 50 are surrounded by the outer layer 50*a* which, in turn is surrounded by the wrapper 51, e.g., a converted web of cigarette paper or the like.

The trimming device 53 removes the surplus 49*a* of the stream 49 so that the remaining portion of the stream 49 forms the filler 50 which is thereupon draped and subdivided in a manner not forming part of the present invention. Reference may be had, for example, to the aforementioned commonly owned U.S. Pat. No. 4,185,644 and to numerous expired and unexpired U.S. patents of the assignee of the present application.

An important advantage of the improved method and apparatus is that the ribs 13*a*, 13*b* which are confined in the inner portion 50*b* of the rod-like filler 50 are highly unlikely to damage (particularly puncture) the wrapper 51. In addition, when a rod-shaped smokers' product including a portion of the filler 50 is lighted, the lighted end is less likely to contain slowly burning glowing large fragments of ribs which could drop and damage a carpet or another floor covering. Still further, introduction of ribs 13*a*, 13*b* into the inner or central portion 50*b* of the filler 50 enhance the hardness of the filler with attendant savings in tobacco.

Segregation of all tobacco ribs 13 from the mixture in the funnel-shaped member 7 is desirable and advantageous on the ground that the thus segregated ribs can be introduced into a selected portion of the flow 22 of loose shreds 12*a* in order to ensure that the final product will have a composition which is constant from end to end as long as the mixture which forms the shower 6 contains a constant percentage of ribs 13. Moreover, segregation of all tobacco ribs from the shower 6 ensures that the reintroduced ribs are remote from the wrapper 51 so that the latter is less likely to be punctured and or otherwise damage than in heretofore known rod making machines. All that is necessary is to introduce the processed ribs 13*a* and 13*b* between two halves of the flow 22 in such a way that the ribs gather in the inner portion 50*b* of the filler 50.

The comminuting device 46 exhibits the advantage that the size of each and every rib which is reintroduced into the flow 22 of shreds 12*a* need not exceed the range of sizes which are customary for tobacco shreds. This takes place irrespective of whether at least some tobacco ribs 13 in the shower 6 are much larger than an average shred. The comminuting action of the device 46 can be selected in such a way that the maximum size of comminuted ribs 13*a* does not exceed the standard size of tobacco shreds. Another advantage of the comminuting device 46 is that it renders it possible to put to use each and every constituent of the shower 6, i.e., all of the shreds 12*a*, all of the smaller tobacco ribs 13*b* and all of the larger tobacco ribs 13*a* (and more specifically all fragments of comminuted larger tobacco ribs 13*a*).

The pneumatic conduit 44 ensures gentle treatment of all tobacco ribs, and the conveying means 48 (which follows the discharge end of the conduit 44) ensures reliable introduction of the mixture of non-comminuted ribs 13*b* and comminuted tobacco ribs 13*a* into a selected portion of the flow 22, namely into a portion which enters the path beneath the underside of the lower reach of the conveyor 26 substantially midway between the upstream and downstream ends 24*a*, 24*b* of the stream building zone 24. This, in turn, ensures, that the ribs 13*a* and 13*b* are concentrated in the inner portion 50*b* of the filler 50, i.e., of that portion of the stream 49 which is used in the rod-shaped smokers' products.

It is within the purview of the invention to use the funnel-shaped member 7 exclusively for admission of tobacco shreds 12*a* and to admit tobacco ribs 13*a*, 13*b* into the trough 37 from a separate source, i.e., not by way of the cell wheel 16 and duct 17. The illustrated apparatus is preferred at this time because the flow 22 which reaches the channel 31 contains only those tobacco ribs which were present in the corresponding portion of the column 1*a* of comminuted tobacco particles in the duct 1.

As mentioned above, the invention can be embodied with equal or similar advantage in apparatus for simultaneously producing a plurality of tobacco fillers, particularly in apparatus wherein the flow of loose tobacco particles id divided into several narrower flows each of which is directed into a discrete channel, e.g., in a manner as disclosed in the aforementioned commonly owned U.S. Pat. No. 4,889,138. The disclosures of U.S. patents which are mentioned herein are incorporated by reference.

A presently preferred comminuting device 46 for relatively large tobacco ribs 13*a* is shown in FIGS. 4 and 5. This device comprises a tubular inlet 52 for admission of tobacco ribs 13*a* which leave the upper compartment 39 of the vibratory trough 37. Comminuted tobacco ribs (denoted by the character 13*b* because their size.can match or approximate that of the ribs 13*b* leaving the lower compartment 41 of the trough 37) leave the comminuting device 46 by way of a tubular outlet 53 which admits the comminuted ribs into the conduit 44. The tubular inlet 52 and the tubular outlet 53 form part of an elongated housing 54 having a cylindrical internal surface with radially inwardly extending circumferentially and/or axially offset stationary comminuting members 56 cooperating with driven comminuting members 57 on a rotor 58 which is rotatably journalled in the end walls of the housing 54 and is driven by an electric or other suitable motor 61 through the medium of a transmission. The illustrated transmission comprises a first (preferably toothed) pulley 62 on the output element of the motor 61, a second (preferably toothed) pulley 63 on the rotor 58, and a (preferably toothed) endless belt 64 which is trained over the pulleys 62 and 63. The left-hand end wall of the housing 54 carries a plate 59 or an analogous support for the motor 61. When the motor 61 is started to drive the rotor 58 and the mobile comminuting members 57 thereon, the relatively large tobacco ribs 13*a* which are admitted via inlet 52 are automatically comminuted on their way toward the outlet 53 which discharges the comminuted ribs 13*b* into the conduit 44.

FIG. 6 shows a presently preferred embodiment of a pneumatic ejector 47 which can be installed in the conduit 44 downstream of the outlet 53 of the comminuting device 46 to advance non-comminuted (relatively small) tobacco ribs 13*a* coming from the compartment 41 and the comminuted tobacco ribs coming from the outlet 53 into the stream building zone 24 (as indicated by the arrow 44*a* in FIG. 2). The ejector 47 comprises a tubular section 66 which receives tobacco ribs 13*a*. The downstream end portion of the section 66 is surrounded by a ring-shaped casing 67 which has a port 68 for compressed air supplied by a suitable source (e.g., by one of the plenum chambers which are shown in FIG. 1 or by the source of compressed air which delivers compressed air to the plenum chambers). The port 68 admits compressed air into an annular chamber 69 which is defined in part by the casing 67 and in part by the tubular section 66 and has an annular orifice 71 to admit a jet of compressed air into that portion of the conduit 44 which is located downstream of the ejector 47. The direction in which accelerated tobacco ribs 13*a* advance toward the stream building zone 24 is denoted by the arrow 44*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of making rod-shaped smokers' products from tobacco shreds having a first range of sizes and tobacco ribs at least some of which have a second range of sizes larger than the sizes of said first range, comprising the steps of accumulating the shreds into an elongated flow of loose shreds; converting successive increments of the flow into an elongated stream having an outer portion and an inner portion surrounded by said outer portion; comminuting said at least some tobacco ribs to a range of sizes approximating said first range of sizes; and effecting the introduction of at least the majority of ribs, including the comminuted ribs, into the inner portion of said stream.

2. The method of claim 1, further comprising the steps of advancing the flow along a first elongated path and transporting the stream along a second elongated path which crosses and extends transversely of said first path, said converting step including transferring successive increments of the flow from said first path into said second path.

3. The method of claim 2, wherein said transferring step is carried out at the locus of crossing of said first and second paths.

4. The method of claim 1, wherein the inner portion of the stream has a center and said introduction effecting step includes effecting introduction of ribs at or at least close to the center of the stream.

5. The method of claim 1, further comprising the steps of jointly conveying the shreds and the ribs along a predetermined path prior to said converting step, and segregating the ribs from the shreds in said path prior to said comminuting step.

6. The method of claim 5, wherein said segregating step comprises sifting the shred and the ribs in a portion of said path.

7. The method of claim 5, further comprising the step of classifying the segregated ribs according to size prior to said comminuting step.

8. The method of claim 7, wherein said classifying step includes sieving the ribs.

9. The method of claim 7, wherein said comminuting step includes reducing only the size of classified ribs having a size within said second range and further comprising the step of admixing comminuted ribs to the non-comminuted ribs prior to said introduction effecting step.

10. The method of claim 9 wherein said introduction effecting step comprises admitting the comminuted and non-comminuted ribs into said flow.

11. The method of claim 1, wherein said introduction effecting step includes pneumatically admitting the ribs into said flow.

12. The method of claim 1, wherein said introduction effecting step comprises admitting the ribs into said flow including conveying the ribs along an arcuate path.

13. The method of claim 12, wherein said conveying step includes moving the ribs along an elongated concave surface.

14. Apparatus for making rod-shaped smokers' products from tobacco shreds having a first range of sizes and tobacco ribs at least some of which have a second range of sized larger than the sizes of said first range, comprising means for advancing a flow of loose shreds along a first elongated path; transporting means including a conveyor defining an elongated second path and arranged to receive successive increments of the flow so that the thus received increments form a stream which advances along said second path in a predetermined direction and has an outer portion and an inner portion surrounded by the outer portion, and means for establishing with said conveyor an elongated stream building zone having an upstream end and a downstream end; and means for processing the ribs, including means for admitting processed ribs into said first path at a location such that the admitted ribs reach said stream building zone intermediate said upstream and downstream ends.

15. The apparatus of claim 14, wherein said advancing means includes means for advancing a mixture of shreds and ribs toward said second path, said processing means including means for segregating ribs from said first path and means for delivering segregated ribs to said admitting means for reintroduction into said first path between said segregating means and said zone.

16. The apparatus of claim 15, wherein said processing means further comprises means for classifying segregated ribs according to size ahead of said delivering means.

17. The apparatus of claim 16, wherein said classifying means includes a sifting device.

18. The apparatus of claim 16, wherein said classifying means comprises a vibrating through and a sieve in said trough, said sieve and said trough defining a first compartment disposed above said sieve and receiving segregated ribs and a second compartment beneath said sieve, said sieve having a mesh such that ribs having one of said second range of sizes are intercepted to be advanced in said first compartment whereas the ribs of a size less than one of said second range of sizes are free to enter into and to advance in said second compartment.

19. The apparatus of claim 18, wherein said first compartment has an outlet and said processing means further comprises means for comminuting intercepted ribs which leave said first compartment by way of said outlet, said comminuting means being disposed ahead of said delivering means.

20. The apparatus of claim 19, wherein said second compartment has an outlet and said delivering means includes means for conveying ribs from the outlet of said second compartment and comminuted ribs from said comminuting means to said admitting means.

21. The apparatus of claim 20, wherein said conveying means comprises a conduit and a pneumatic ejector in said conduit.

22. The apparatus of claim 15, wherein said admitting means has a concave surface along which the ribs advance toward and into said first path.

23. The apparatus of claim 14, wherein said admitting means includes means for introducing ribs into said one path at a location such that the ribs are centered in the inner portion of the stream.

* * * * *